United States Patent [19]

Brill

[11] 4,390,079

[45] Jun. 28, 1983

[54] MUFFLER AND EXHAUST EXTRACTOR

[76] Inventor: Robert Brill, 815 Nile St., Golden, Colo. 80401

[21] Appl. No.: 209,192

[22] Filed: Nov. 21, 1980

Related U.S. Application Data

[63] Continuation-in-part of Ser. No. 73,532, Sep. 7, 1979, abandoned.

[51] Int. Cl.[3] ..... F01N 7/08; F01N 1/14

[52] U.S. Cl. ..... 181/227; 181/228; 181/263

[58] Field of Search ..... 180/220, 227, 228, 259, 180/262-263; 60/317-319, 689

[56] References Cited

U.S. PATENT DOCUMENTS 2,386,305 10/1945 Flickinger ..... 181/259
3,952,823 4/1976 Hinderks ..... 181/263 X

FOREIGN PATENT DOCUMENTS 657569 5/1929 France ..... 181/259
249518 6/1927 United Kingdom ..... 181/259

*Primary Examiner*—Richard A. Wintercorn
*Assistant Examiner*—Thomas H. Tarcza
*Attorney, Agent, or Firm*—Stephen Gratton

[57] ABSTRACT

A muffler and exhaust extractor especially adapted for internal combustion engine powered vehicles such as over the road diesel tractors. The muffler and exhaust extractor generally stated comprises a pair of spaced curved airfoils for directing the airstream produced by the moving vehicle through an open ended converging-diverging passage to form a low pressure area for gas extraction, and means for mounting the airfoils such that the low pressure area is adjacent to and in communication with the exhaust outlet of the vehicle.

4 Claims, 7 Drawing Figures

MUFFLER AND EXHAUST EXTRACTOR

FIELD OF THE INVENTION

This application is a continuation in part of my copending application entitled Diesel Exhaust Extractor Silencer, Ser. No. 073,532, which was filed Sept. 7, 1979 now abandoned.

This invention relates generally to exhaust extractors and noise abatement mufflers for vehicles having internal combustion engines. More particularly the invention relates to a new and improved muffler and exhaust extractor adapted to reduce engine noise and utilize the airstream created by movement of a vehicle to reduce engine exhaust back pressure. The invention is particularly adapted to vehicles such as diesel trucks having an exhaust stack that extends into the airstream created by movement of the truck.

DESCRIPTION OF THE PRIOR ART

Exhaust mufflers for internal combustion engines are well known in the prior art. A major disadvantage of most prior art exhaust mufflers however, is that they create excessive back pressure which has a detrimental effect on the efficiency of the engine. In the past various exhaust pipe attachments have been proposed for internal combustion engines to reduce back pressure at the exhaust while simultaneously muffling the noise of the exhausting gases. U.S. Pat. Nos. 2,386,305; 2,922,486; 3,592,292; and 3,642,093 for instance are representative devices of this type. Other prior art exhaust pipe attachments such as U.S. Pat. No. 3,043,097 and U.K. Pat. No. 249,518 are not concerned with exhaust noise but merely attempt to eliminate back pressure at the exhaust.

Most of these prior art devices utilize ram air created by movement of the vehicle, that is either converged or otherwise diverted to form low pressure areas for extracting the exhaust gases. A problem with all of these prior art devices is that because of their construction they must be mounted to a generally horizontally running exhaust pipe which is typically on the underside of the vehicle. This mounting arrangement necessarily complicates the structure of these devices and adversely effects their efficiency in creating low pressure areas for extracting exhaust gases. In addition the mounting of these devices on the underside of a vehicle often makes it impossible to expose the device to an unobstructed airstream.

SUMMARY OF THE INVENTION

The present invention is directed to a muffler and exhaust extractor that is designed to be mounted to a vertically or substantially vertically running exhaust pipe such as would typically occur on an over the road diesel tractor or the like. The structure of the present invention is effective in reducing both back pressure and noise from exhaust gases. In addition the device is inexpensive to manufacture and can be mounted in a position such as over the top of a vehicle where there is unobstructed access to the airstream formed by movement of the vehicle.

Generally stated the muffler and exhaust extractor of the invention comprises a pair of spaced curved airfoils for directing the airstream of the moving vehicle through an open ended converging-diverging passage, to form a low pressure area for gas extraction, and means for mounting the airfoils such that the low pressure area is adjacent to and in communication with the exhaust outlet of the vehicle. In addition to forming a low pressure area adjacent to the exhaust outlet, the airfoils function to produce eddies of turbulent air on either side of the exhaust outlet for absorbing and dissipating sound waves produced by the exhausting gases. Moreover, the airfoils are situated such that additional sound attenuation is produced as the sound waves are reflected and bounced through the airfoils.

Other objects, advantages and capabilities of the present invention will become more apparent as the description proceeds.

DETAILED DESCRIPTION OF THE INVENTION

Figure 1:
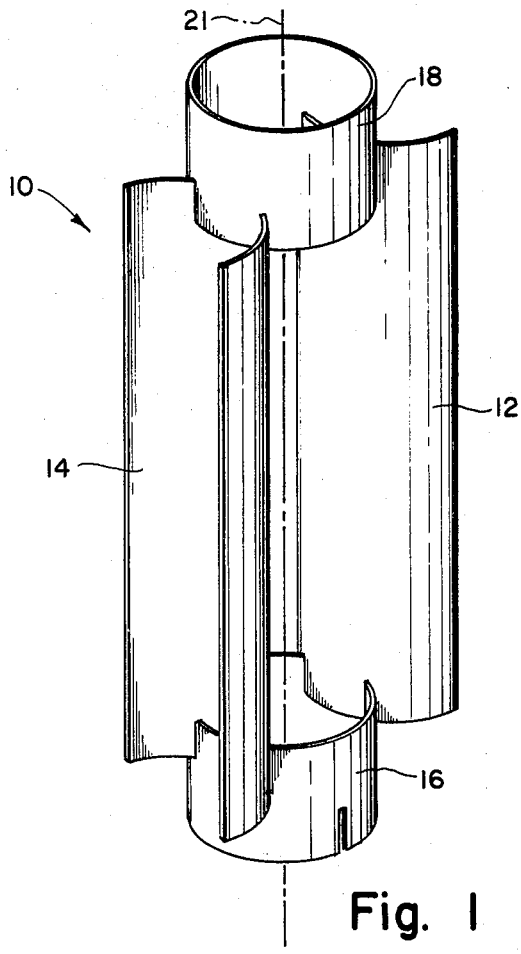
FIG. 1 is a perspective view of a muffler and exhaust extractor constructed in accordance with the invention.
Figure 2:
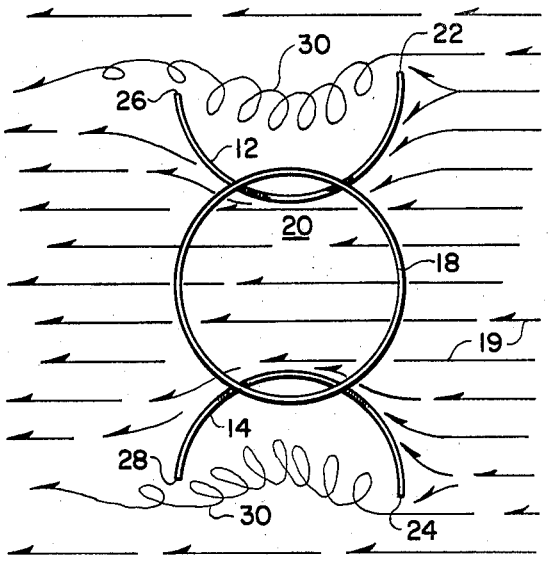
FIG. 2 is a top plan view of the invention showing airflow in and around the muffler and exhaust extractor.

Referring now to FIG. 1 a muffler and exhaust extractor constructed in accordance with the invention is shown and generally designated as 10. Generally stated the muffler and exhaust extractor comprises a pair of opposed spaced airfoils 12 and 14, for directing airflow from a moving vehicle to produce a low pressure area for gas extraction; an inlet pipe section 16 for supporting the airfoils 12 and 14 at their lower end and an outlet pipe section 18 for supporting the airfoils at their upper end. In FIG. 2 the muffler and exhaust extractor 10 is shown in the airstream produced by a moving vehicle. The airstream is denoted by arrows and is generally designated as 19.

Each airfoil 12 and 14 is formed with a curved cross sectional configuration of a predetermined radius of curvature. This curved cross sectional configuration is clearly shown in FIG. 2. In one form of the invention the air foils 12 and 14 are fabricated from an elongated length of four, five, or six inch metal tubing cut along its longitudinal axis. The airfoils 12 and 14 are mounted to the inlet 16 and outlet 18 pipe sections of the muffler and exhaust extractor 10, parallel to one another and to a longitudinal axis 23 that is equidistant between the airfoils 12 and 14, and which extends through the center of the inlet 16 and outlet 18 pipe sections. As shown in FIG. 2 this forms a symmetrical converging diverging passageway for accelerating airflow 19 therethrough to produce a low pressure area 20.

In operation the muffler and exhaust extractor 10 is mounted to the exhaust pipe 21 (FIG. 4) of a vehicle such that this low pressure or venturi area 20 is situated directly above and in communication with the exhaust outlet of the exhaust pipe 21 of the vehicle. In addition the muffler and exhaust extractor is preferrably mounted with its longitudinal axis 23 in a vertical or substantially vertical position perpendicular to the flow of the airstream 19 of the moving vehicle. Moreover, the muffler and exhaust extractor is preferrably mounted in a position where there is an unobstructed access to the airstream 19.

The airfoils 12 and 14 in addition to forming a venturi for airflow therebetween are also formed and situated to produce turbulent airflow on either side of the muffler and exhaust extractor 10 for dissipating the sound waves formed by the exhausting gases. This turbulent airflow on either side of the muffler and exhaust extractor 10 is denoted in FIG. 2 by the swirls that are generally designated as 30. To inhance the formation of turbulent air 20 the leading edges 22 and 24, of the airfoils 12 and 14 respectively are axially outwardly offset from the trailing edges 26 and 28 of the airfoils.

Figure 3:
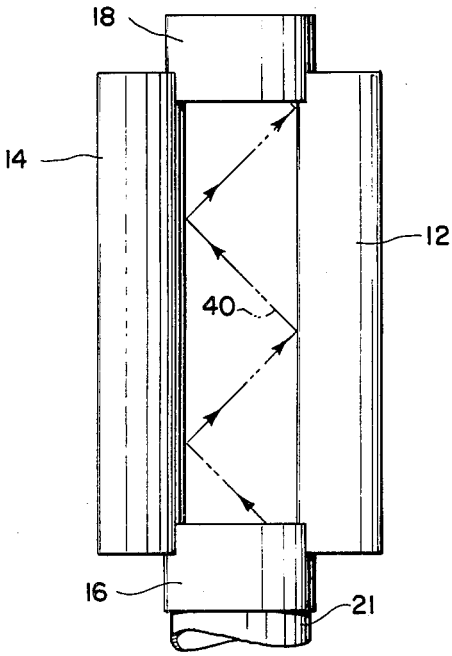
FIG. 3 is a side elevation view of the invention showing the path of soundwaves through the muffler and exhaust extractor.
Figure 6:
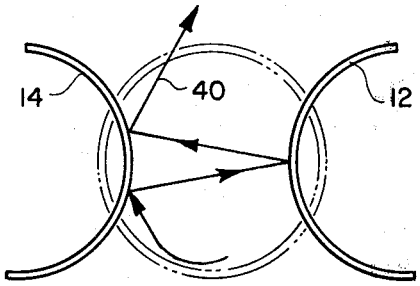
FIG. 6 is a top plan view with parts removed showing the reflection of sound waves through the muffler and exhaust extractor.

In addition to enhancing sound dissipation by the formation of turbulent air 30 on either side of the muffler and exhaust extractor 10, the airfoils 12 and 14 also function to reflect and guide the sound waves through the outlet pipe section 18 and also out the back side of the muffler and exhaust extractor. These situations are shown in FIGS. 3 and 6 respectively. In FIG. 3 the sound waves generally designated as 40 are shown being dissipated by reflection through the airfoils 12 and 14 and out the outlet pipe section 18 of the muffler and exhaust extractor. Likewise in FIG. 6 the sound waves 40 are shown being laterally reflected by the curvature of the airfoils 12 and 14 between the airfoils 12 and 14 and out the back of the muffler and exhaust extractor.

The inlet pipe section 16 for the muffler and exhaust extractor 10 may be formed from a length of cylindrical tubing or the like and may be slotted as shown in FIG. 1 to aid in the attachment of the pipe section 16 to the exhaust pipe 21 of the vehicle. Likewise the outlet pipe section 18 may also be formed from a length of cylindrical tubing. In the form of the invention shown the airfoils 12 and 14 are securely attached to the inlet 16 and outlet 18 pipe sections by air tight welding or similar means.

Figure 4:
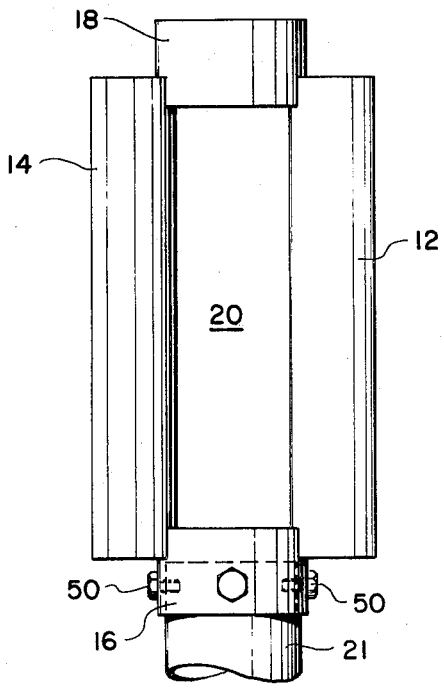
FIG. 4 is a side elevation view showing the mounting of the muffler and exhaust extractor of the invention to an exhaust pipe of a vehicle.
Figure 5:
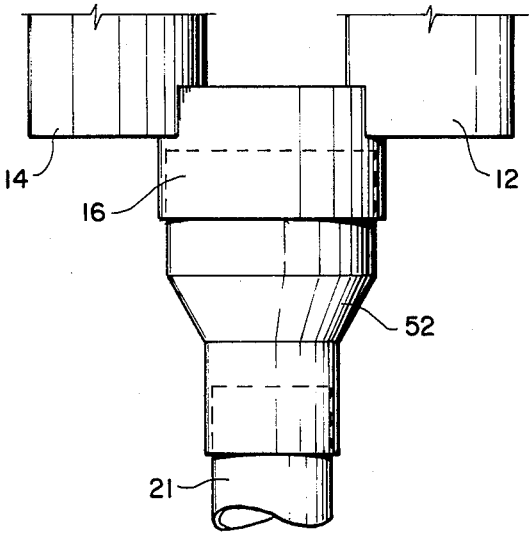
FIG. 5 is a side elevation view showing the mounting of the muffler and exhaust extractor to an exhaust pipe utilizing a tapered adapter.

For attaching the muffler and exhaust extractor 10 to the exhaust pipe 21 (FIG. 4) of a vehicle, the inlet pipe section 16 is sized to fit snuggly over and telescopically engage the outer circumferential surface of the exhaust pipe 21. Mating through holes can then be drilled through the exhaust pipe 21 and inlet pipe section 16 and the assembly can be secured with three or more threaded fasteners 50 (FIG. 4).

Alternately if the inlet pipe section 16 of the muffler and exhaust extractor is not sized to fit snuggly over the exhaust pipe 21 of the vehicle, a tapered adapter section 52, sized to telescopically engage the inlet pipe section 16 at its upper end and the exhaust pipe 21 at its lower end may be utilized and secured in the same manner with threaded fasteners.

Figure 7:
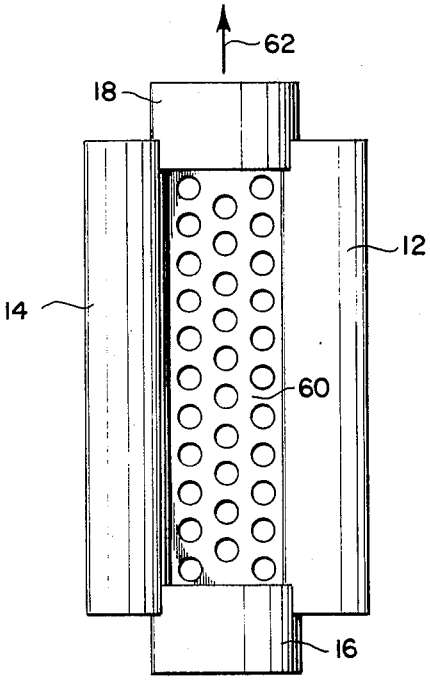
FIG. 7 is a rear elevation view of an alternate embodiment of a muffler and exhaust extractor constructed in accordance with the invention.

An alternate embodiment of the muffler and exhaust extractor is shown in FIG. 7. In the embodiment illustrated in FIG. 7 the back side of the muffler and extractor is closed off with a perforated or expanded metal section 60. In this embodiment nearly all of the flow of exhaust gases from the engine is directed upward through the outlet pipe section 18 as indicated by arrow 62. This embodiment is preferred where the muffler and exhaust extractor 10 does not extend completely above the trailing structure of the vehicle and smoke and exhaust gases laterally exiting through the muffler and exhaust extractor create problems.

OPERATION

Thus the muffler and exhaust extractor 10 of the invention functions to eliminate back pressure at a vehicles exhaust by creating a low pressure or venturi area immediately above and in communication with the vehicles exhaust outlet. This low pressure exhaust extraction improves the efficiency and operation of the internal combustion engine itself and also of the engine turbocharger. In addition the muffler and exhaust extractor produces turbulent air for attenuating the sound waves produced by exhausting gases and sound waves are further dissipated by multiple reflections through the airfoils 12 and 14 of the muffler and exhaust extractor.

Although the present invention has been described with a certain degree of particularity it is understood that the present disclosure has been made by way of example and that changes in details of structure may be made without departing from the spirit thereof.

What is claimed is:

1. An exhaust pipe attachment for internal combustion powered vehicles comprising:

first and second curved airfoils mounted parallel to and spaced from one another and to a longitudinal axis generally perpendicular to the direction of movement of the vehicle to form an open ended converging diverging passageway for accelerating airflow therethrough to produce a low pressure area;

means for mounting the first and second airfoils in the airstream produced by moving the vehicle generally perpendicular to the direction of flow of the airstream with the open ended converging diverging passageway adjacent to and in communication with an exhaust outlet of the vehicle such that the exhaust gases flow into the low pressure area and such that turbulent air is produced on either side of the airfoils for dissipating the sound waves formed by the exhausting gases.

2. The exhaust pipe attachment as defined in claim 1 and wherein the mounting means comprises a first generally cylindrically shaped inlet pipe section attached to the airfoils at one end for mounting the airfoils to an exhaust pipe of the vehicle generally perpendicular to the direction of airflow of the moving vehicle and an outlet pipe section attached to the air foils at the opposite end for supporting the air foils.

3. The exhaust pipe attachment as defined in claim 2 and wherein each airfoil is mounted with a leading edge axially outwardly offset from a trailing edge to produce turbulent air for sound dissipation.

4. The exhaust pipe attachment as defined in claim 3 and wherein the airfoils are formed from elongated lengths of cylindrical tubing cut along their longitudinal axis.

* * * * *